US009033809B2

(12) United States Patent
Haut et al.

(10) Patent No.: US 9,033,809 B2
(45) Date of Patent: May 19, 2015

(54) CHILD SWING APPARATUS

(71) Applicant: Wonderland Nurserygoods Company Limited, Central Hong Kong (HK)

(72) Inventors: Robert E. Haut, West Chester, PA (US); Nathaneal Saint, Morgantown, PA (US); Peter R. Tuckey, Leola, PA (US); Jonathan K. Mountz, Geigertown, PA (US)

(73) Assignee: Wonderland Nurserygoods Company Limited, Hong Kong (HK)

( * ) Notice: Subject to any disclaimer, the term of this patent is extended or adjusted under 35 U.S.C. 154(b) by 60 days.

(21) Appl. No.: 13/845,720

(22) Filed: Mar. 18, 2013

(65) Prior Publication Data

US 2013/0244803 A1 Sep. 19, 2013

Related U.S. Application Data

(60) Provisional application No. 61/685,490, filed on Mar. 19, 2012.

(51) Int. Cl.
*A47D 13/10* (2006.01)
*A47D 9/02* (2006.01)

(52) U.S. Cl.
CPC ..... *A47D 13/105* (2013.01); *A47D 9/02* (2013.01)

(58) Field of Classification Search
CPC ..... A63G 13/00; A47D 13/105
USPC ..... 472/119, 95
See application file for complete search history.

(56) References Cited

U.S. PATENT DOCUMENTS

| | | | | |
|---|---|---|---|---|
| 4,028,753 | A | 6/1977 | Rios | |
| 7,824,273 | B2 * | 11/2010 | Clapper et al. | 472/95 |
| 7,845,728 | B2 | 12/2010 | Chen et al. | |
| 8,047,609 | B2 | 11/2011 | Chen et al. | |
| 8,197,005 | B2 | 6/2012 | Hopke et al. | |
| 8,239,984 | B2 | 8/2012 | Hopke et al. | |

FOREIGN PATENT DOCUMENTS

| | | | |
|---|---|---|---|
| CN | 202140523 | U | 2/2012 |
| KR | 101088680 | | 12/2011 |
| WO | 2006096712 | A2 | 9/2006 |
| WO | 2007056684 | A2 | 5/2007 |

* cited by examiner

*Primary Examiner* — Michael Dennis
(74) *Attorney, Agent, or Firm* — David I. Roche; Baker & McKenzie LLP

(57) ABSTRACT

A child swing apparatus can include a support frame, a seat support for receiving the placement of a child, a swing arm assembled with the support frame about a pivot axis, the swing arm holding the seat support, a driven part arranged radially spaced apart from the pivot axis and movable with the seat support and the swing arm relative to the support frame, and a drive mechanism assembled with the support frame, wherein the drive mechanism has a driving end operable to apply a torque on the driven part to cause swing motion of the seat support.

28 Claims, 16 Drawing Sheets

CHILD SWING APPARATUS

CROSS-REFERENCE TO RELATED APPLICATION

This application claims priority to U.S. Provisional Patent Application No. 61/685,490 filed on Mar. 19, 2012, which is incorporated herein by reference.

BACKGROUND

1. Field of the Invention

The present inventions relate to child swing apparatuses.

2. Description of the Related Art

Swing apparatuses can be used by parents to help calming or entertaining a child. A child swing apparatus typically travels at a natural frequency in a pendulum motion. The drive system for the swing apparatus is generally located at the pivot point of the pendulum at a high location in the frame structure of the swing apparatus. While the conventional pendulum motion requires driving at the point of highest torque, the system can store the potential energy from one half cycle to another, requiring only a soft push or pull to maintain or increase the amplitude.

However, a few drawbacks may exist in the conventional swing apparatuses. In particular, the swinging motion and frequency are generally locked as a function of the length of the swing arm. If a slower frequency is needed along a same motion path, it may be extremely difficult to exert a driving torque for overcoming the gravitational force acting in the pendulum motion. Accordingly, the drive systems applied in most of the currently available swing apparatuses still cannot allow truly adjustable swinging frequency.

Therefore, there is a need for an improved structure that can address at least the aforementioned issues.

SUMMARY

The present application describes child swing apparatuses that can allow a broader range of swinging frequencies, speeds and motion paths, and can operate with a motor having a smaller torque output. In one embodiment, the child swing apparatus can include a support frame, a seat support for receiving the placement of a child, a swing arm assembled with the support frame about a pivot axis, the swing arm holding the seat support, a driven part arranged radially spaced apart from the pivot axis and movable with the seat support and the swing arm relative to the support frame, and a drive mechanism assembled with the support frame, wherein the drive mechanism has a driving end operable to apply a torque on the driven part to cause swing motion of the seat support.

DETAILED DESCRIPTION OF THE EMBODIMENTS

Figure 1:
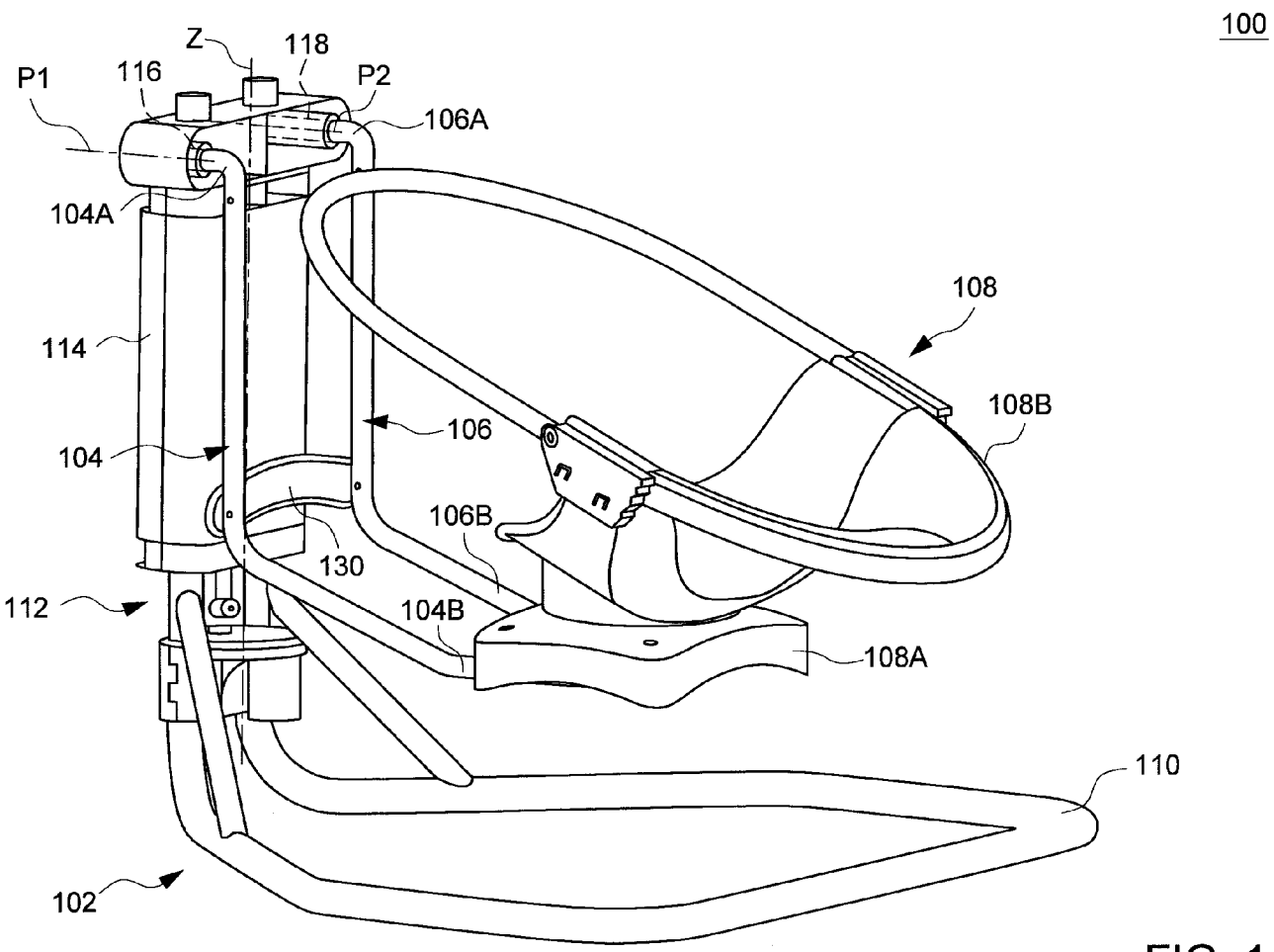
FIG. 1 is a schematic view illustrating an embodiment of a child swing apparatus.

FIG. 1 is a schematic view illustrating an embodiment of a child swing apparatus 100. The swing apparatus 100 can include a support frame 102, one or more swing arm (two swing arms 104 and 106 are shown in the illustrated embodiment) and a seat support 108. The support frame 102 can include a base frame 110 extending along a horizontal plane, and an upright column 112 projecting along a vertical axis Z perpendicular to the horizontal plane of the base frame 110. The base frame 110 can provide stable resting support on a ground and below the seat support 108. The upright column 112 can have a lower end connected with the base frame 110, and an upper portion pivotally assembled with the swing arms 104 and 106.

The embodiment shown in FIG. 1 exemplary includes two swing arms 104 and 106. However, other embodiments of the child swing apparatus may also use one swing arm 104 or 106. The swing arm 104 can be formed as an assembly of bent tubes, including a vertical segment having an upper end portion 104A that is assembled with the support frame 102 about a pivot axis P1, and a horizontal segment 104B that extends below the upper end portion 104A and is connected with the seat support 108. Likewise, the swing arm 106 can be formed as an assembly of bent tubes, including a vertical segment having an upper end portion 106A that is assembled with the support frame 102 about a pivot axis P2, and a horizontal segment 106B that extends below the upper end portion 106A and is connected with the seat support 108. The pivot axes P1 and P2 are parallel and horizontally spaced apart from each other, and are arranged at the same height. The swing arms 104 and 106 can thereby swing about the pivot axes P1 and P2, and hold the seat support 108 at a height above the ground.

The support frame 102 may also include a housing 114 movably assembled with the upright column 112. The housing 114 can be assembled with two horizontally spaced-apart shafts 116 and 118 about which the first end portions 104A and 106A of the swing arms 104 and 106 are respectively mounted pivotally with the housing 114. In one embodiment, the housing 114 can also be driven by a vertical motion drive mechanism (not shown) to move vertically along the upright column 112. Accordingly, displacement of the housing 114 along the vertical axis Z of the upright column 112 can vertically move the shafts 116 and 118 to impart motion to the swing arms 104 and 106 and the seat support 108 along the vertical axis Z.

Referring again to FIG. 1, the seat support 108 can include a lower portion 108A connected with the swing arms 104 and 106, and an upper portion 108B for receiving a child. The lower portion 108A of the seat support 108 can be pivotally connected with the horizontal segments 104B and 106B of the swing arms 104 and 106. The upper portion 108B can be permanently affixed with the lower portion 108A, or can be provided as a portable holding device that can be attached with and detached from the lower portion 108A.

Figure 2:
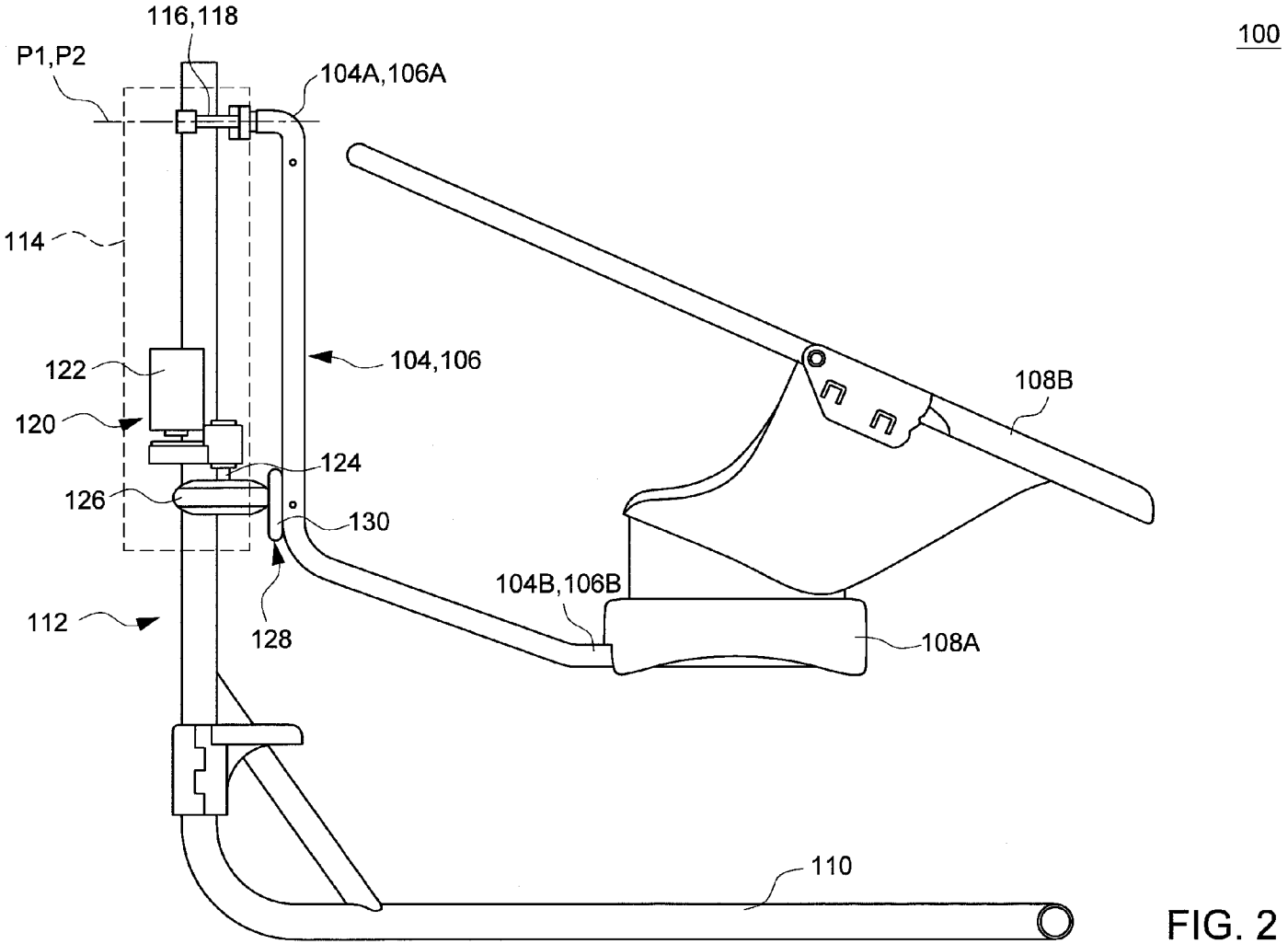
FIG. 2 is a side view illustrating a drive mechanism for imparting swing motion to a seat support in the child swing apparatus.

In conjunction with FIG. 1, FIG. 2 is a side view illustrating a drive mechanism 120 for imparting motion to the swing arms 104 and 106, and the seat support 108. For clarity, the housing 114 is shown with phantom lines in FIG. 2. The drive mechanism 120 can include an electric motor 122, a rotary axle 124 operatively connected with the output of the motor 122, and a wheel 126 affixed with the rotary axle 124. The motor 122, the rotary axle 124 and the wheel 126 can be assembled with the upright column 112 so as to be horizontally fixed and not movable. In one embodiment, some or all of the components of the drive mechanism 120 can be assembled with the upright column 112 vertically below the pivot axes P1 and P2 of the swing arms 104 and 106. Moreover, the housing 114 and some or all of the components of the drive mechanism 120 (e.g., including the wheel 126 and the rotary axle 124) can be assembled together as a block that is vertically movable along the upright column 112. Examples of the motor 122 can include DC motors that may be controlled by a pulse width modulation (PWM) controller. The rotary axle 124 can extend vertically adjacent to the upright column 112 and behind the seat support 108, and can be driven by the motor 122 so as to rotate the wheel 126 about a vertical axis.

The wheel 126 can form a driving end of the drive mechanism 120 that is in constant contact with a driven part 128 provided on the assembly formed by the seat support 108 and the swing arms 104 and 106. When the motor 122 drives rotation of the rotary axle 124, the wheel 126 at the driving end of the drive mechanism 120 can apply a torque on the driven part 128 to impart swing motion to the seat support 108. The torque can be constantly applied by the wheel 126 on the driven part 128, and can be in a substantially horizontal direction during the travel of the seat support 108 and swing arms 104 and 106.

Referring to FIGS. 1 and 2, the driven part 128 can be disposed below and radially spaced apart from the pivot axes P1 and P2, and can be movable along with the seat support 108 and the swing arms 104 and 106. In one embodiment, the driven part 128 can include a board 130 made of a rigid material that is disposed behind the seat support 108 facing the upright column 112. The board 130 can be pivotally connected with the swing arms 104 and 106, and extend across a gap between the swing arms 104 and 106.

The wheel 126 can be placed adjacent to the upright column 112 and behind the seat support 108 in rolling contact with the board 130. The constant contact between the wheel 126 and the board 130 of the driven part 128 can produce a reaction force that is substantially horizontal. Accordingly, rotation of the wheel 126 can drive movement of the board 130 via the constant rolling contact, which causes the swing arms 104 and 106 to oscillate about the pivot axes P1 and P2 and imparts swing motion to the seat support 108. For facilitating the drive transmission, the wheel 126 can have an outer peripheral region made of a material that promotes grip contact with the board 130. Examples of suitable materials can include, without limitation, urethane and rubber.

Figure 3:
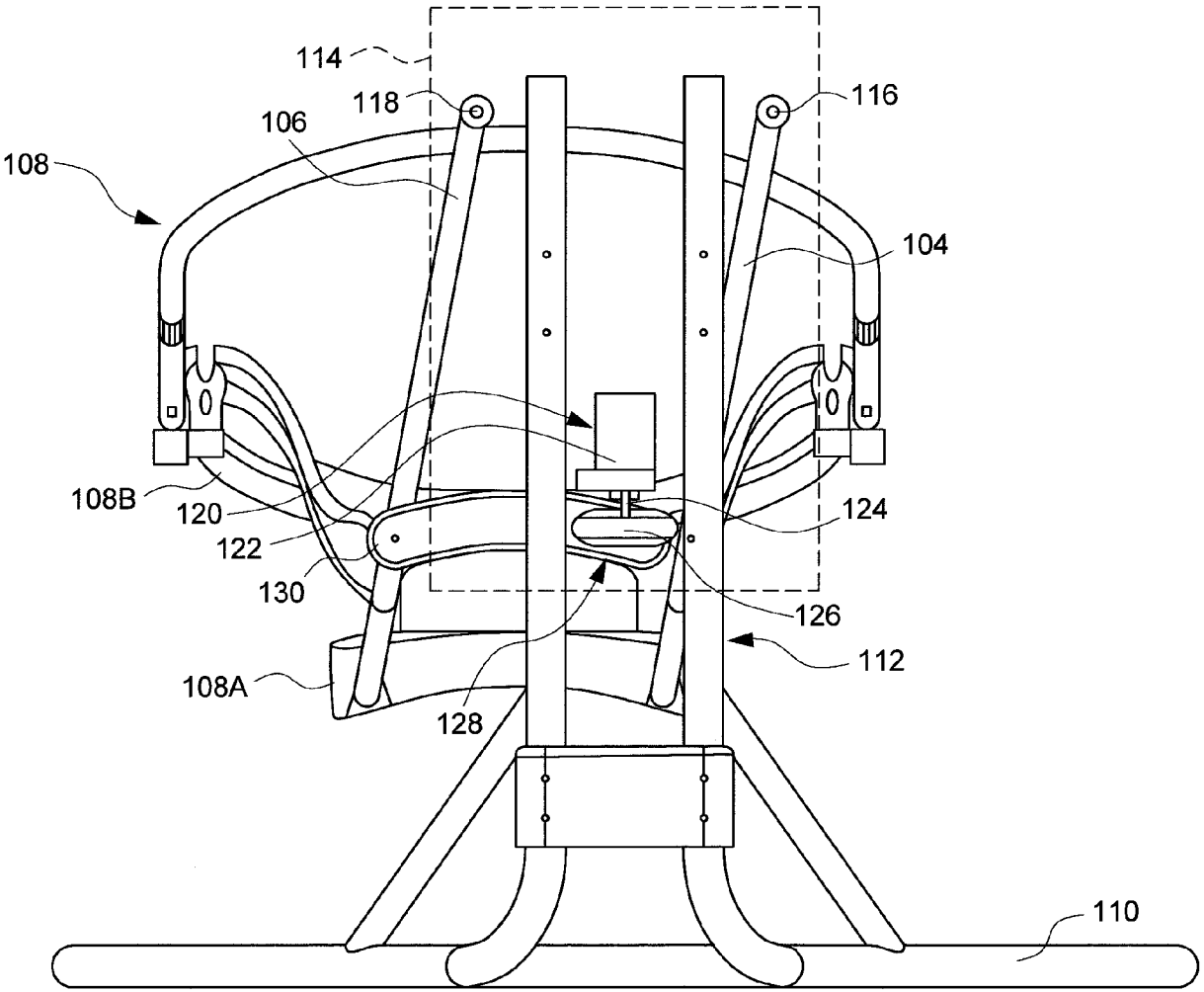
FIG. 3 is a schematic view illustrating a left end position in the swinging travel.
Figure 4:
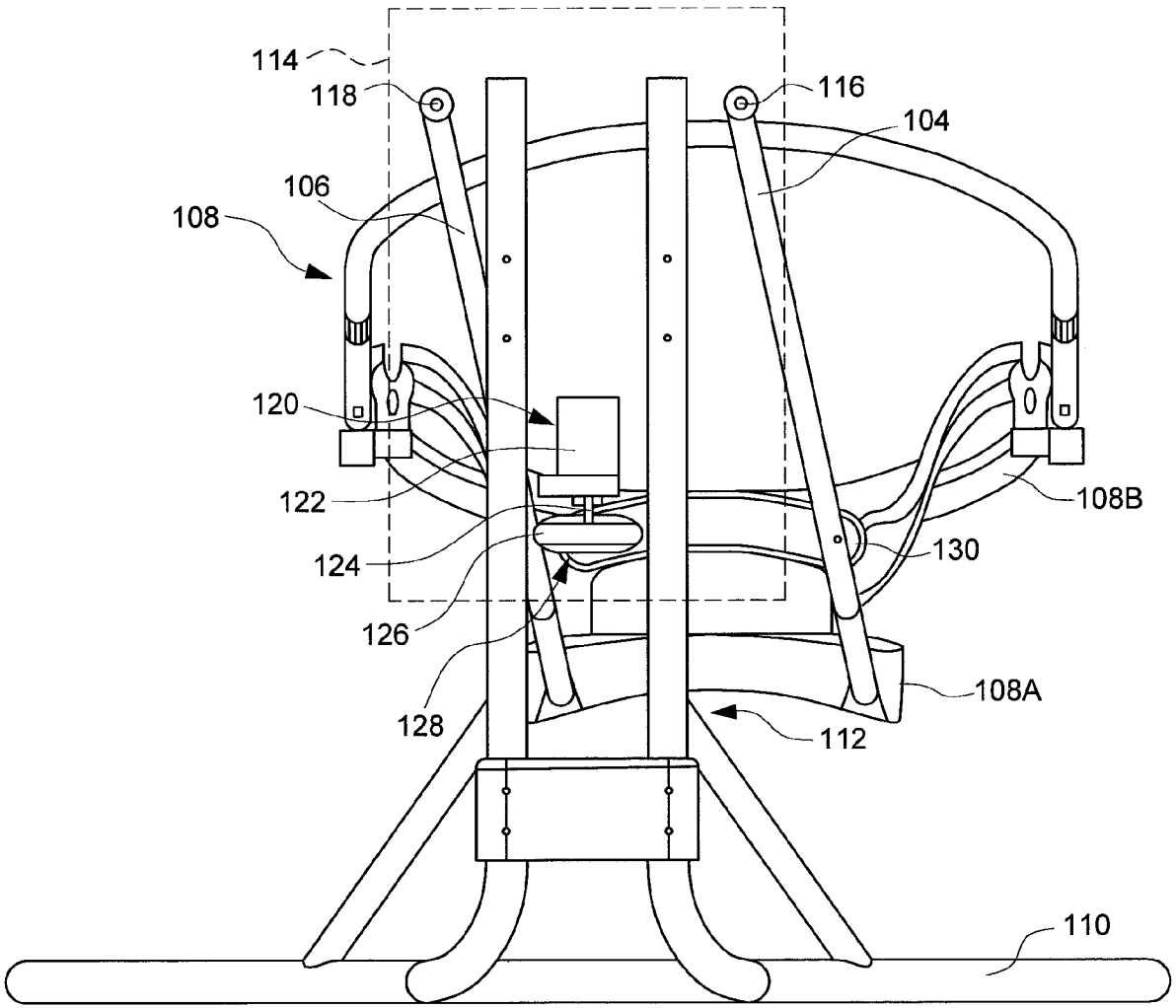
FIG. 4 is a schematic view illustrating a right end position in the swinging travel.

Because the torque applied by the wheel 126 at the driving end of the drive mechanism 120 to the assembly of the seat support 108 and the swing arms 104 and 106 is at a lower location distant from the pivot axes P1 and P2, the motor 122 with a smaller torque output can be used to effectively drive the seat support 108. The rotation of the wheel 126 driven by the motor 122 can accelerate and decelerate to swing the seat support 108 at an adjustable frequency. Accordingly, a natural swinging frequency can be simulated. Moreover, the wheel 126 can be stopped to pause the motion of the seat support 108 at any desirable interval in the travel of the seat support 108. Accordingly, the seat support 108 can be continuously held stationary at any positions in the travel of the seat support 108, e.g., at the left end or right end position of the swinging travel as respectively shown in FIGS. 3 and 4.

Figure 5:
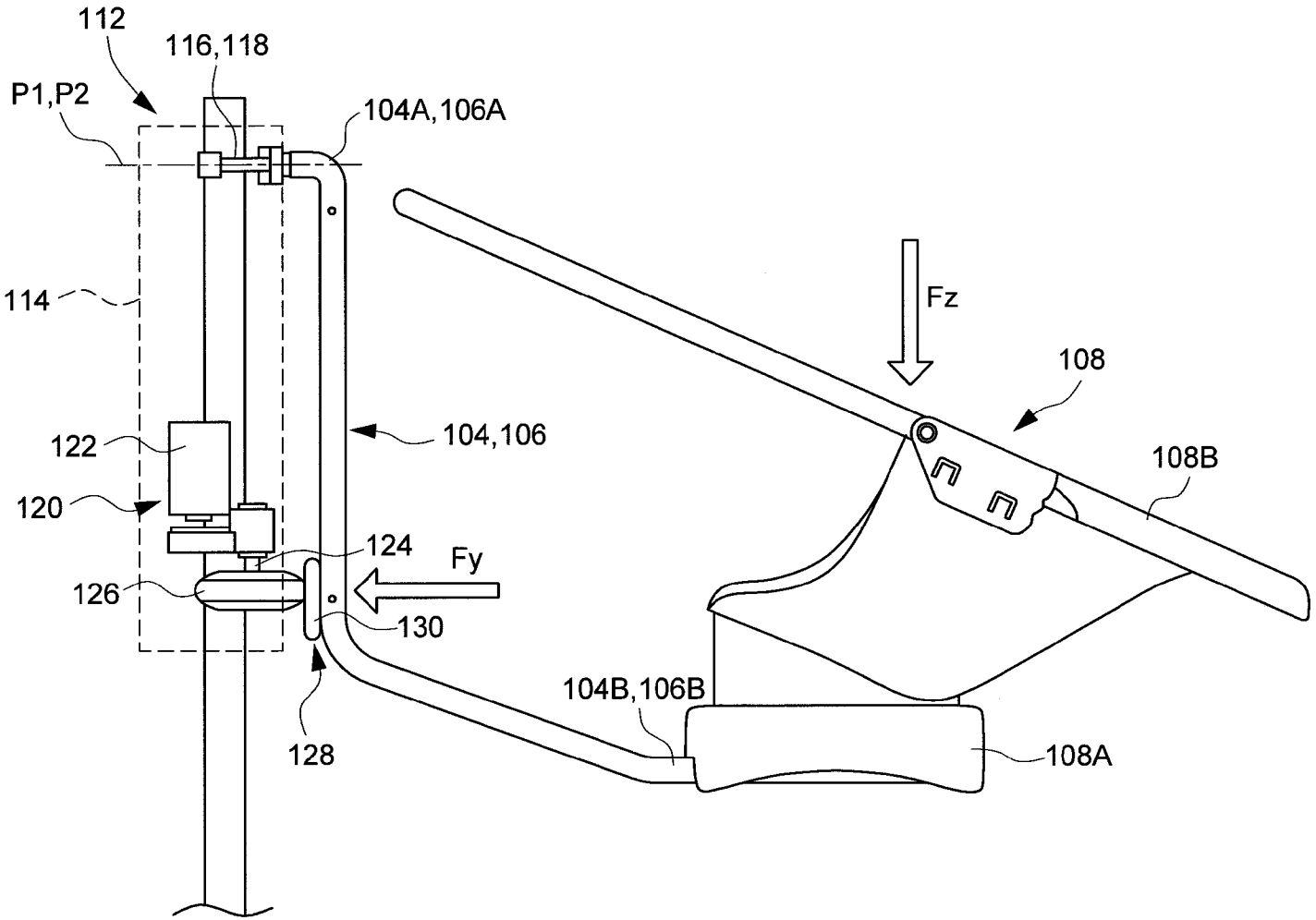
FIG. 5 is a schematic view illustrating a force distribution in the child swing apparatus.

FIG. 5 is a schematic view illustrating a force distribution in the child swing apparatus 100 when a child is placed in the seat support 108. When a child is placed in the seat support 108, a resulting weight Fz can translate into a horizontal force component Fy pressing the driven part 128 (e.g., the board 130) against the wheel 126. The amount of this horizontal force component Fy can depend on the weight Fz bearing on the seat support 108: for example, Fy is smaller when no child is placed in the seat support 108 (the weight Fz in this case is essentially induced by the mass of the seat support 108) than when a child is placed in the seat support 108 (the weight Fz in this case is the sum of the seat support 108 and the weight of the child). Accordingly, the wheel 126 can operate as a slip clutch with a reaction force depending on the weight Fz bearing on the seat support 108. For example, suppose that the seat support 108 is swinging. In case the child placed therein bumps the seat support 108, or a caregiver gets in the way, the wheel 126 can slip relative to the driven part 128 and does not drive the seat support 108 further or harder into the caregiver.

Referring again to FIG. 5, the location where the driven part 128 (e.g., the board 130) contacts with the wheel 126 can be arranged at a vertical height that is substantially adjacent to that of the lower portion 108A of the seat support 108 where connection with the swing arms 104 and 106 is made. For example, the wheel 126 and the driven part 128 can be placed such that the contact location is located slightly above the connection between the lower portion 108A of the seat support 108 and the swing arms 104 and 106. As a result, flexing of the swing arms 104 and 106 (e.g., owing to the weight of a child placed in the seat support 108) can be reduced as it occurs only in the length of the swing arms 104 and 106 that is located between the wheel 126 and the lower portion 108A of the seat support 108. Accordingly, substantially rigidity can be added to the swing arms 104 and 106.

Figure 6:
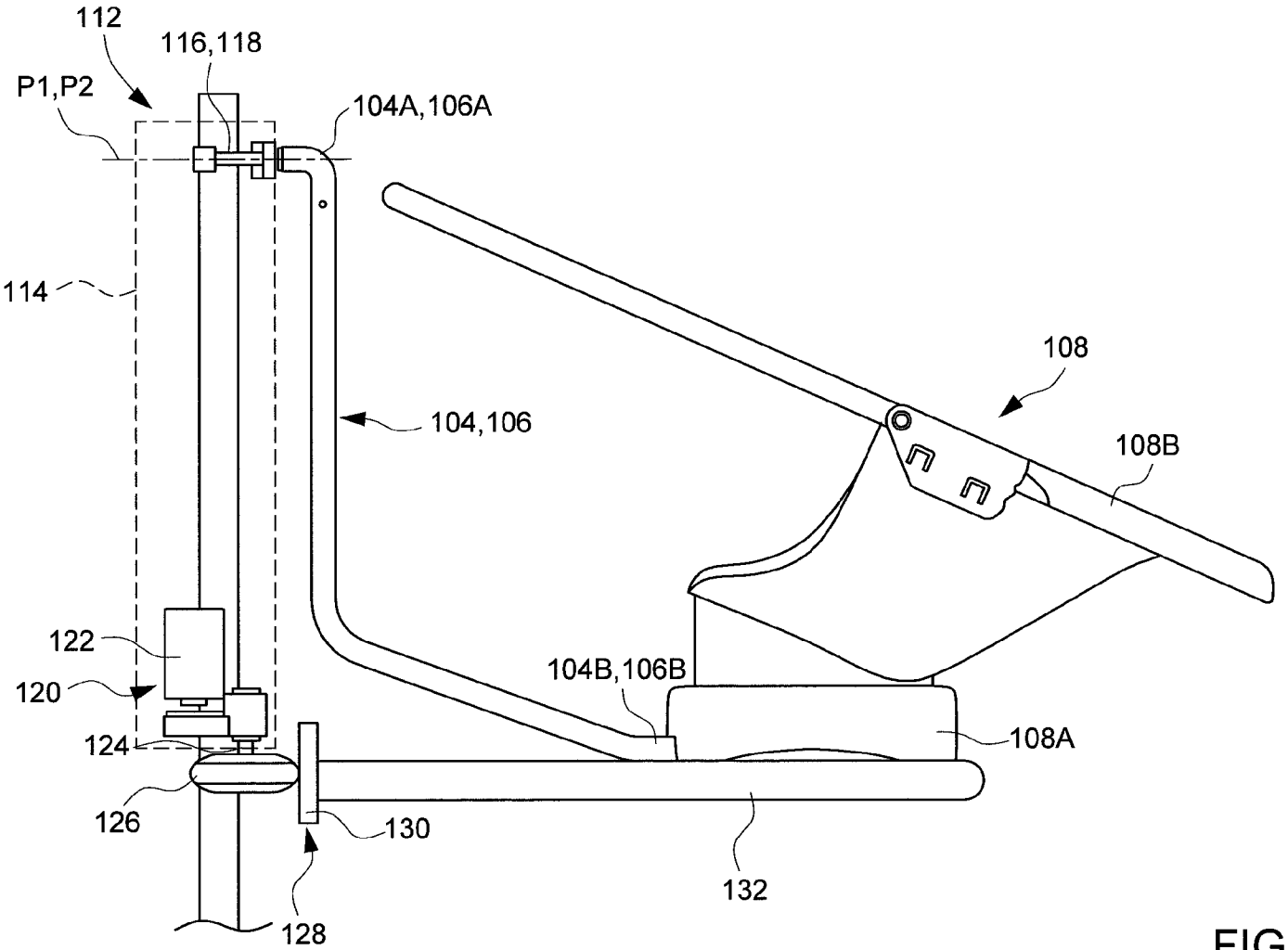
FIGS. 6-8 are schematic views illustrating different variant embodiments of the child swing apparatus.
Figure 7:
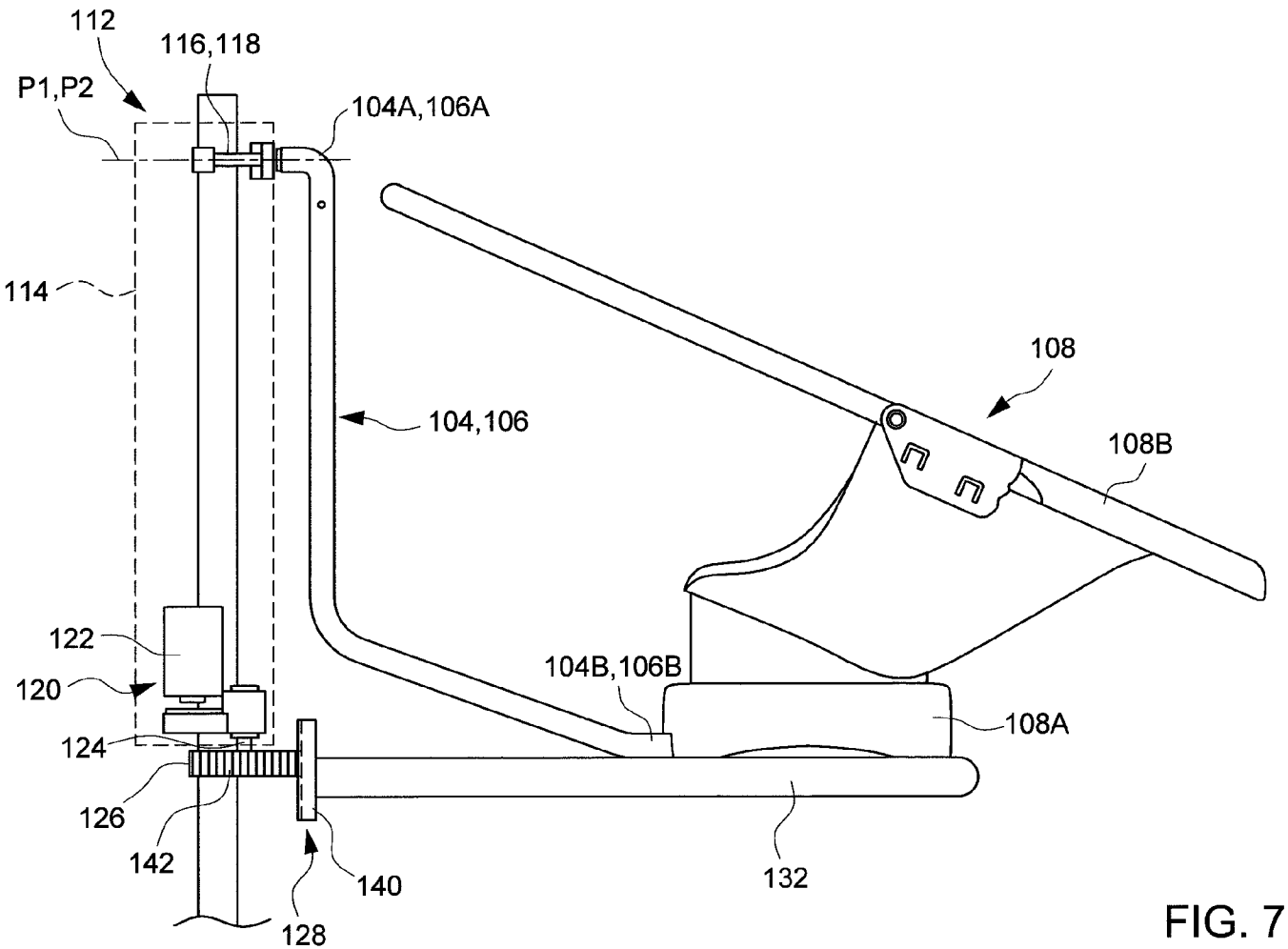
Figure 8:
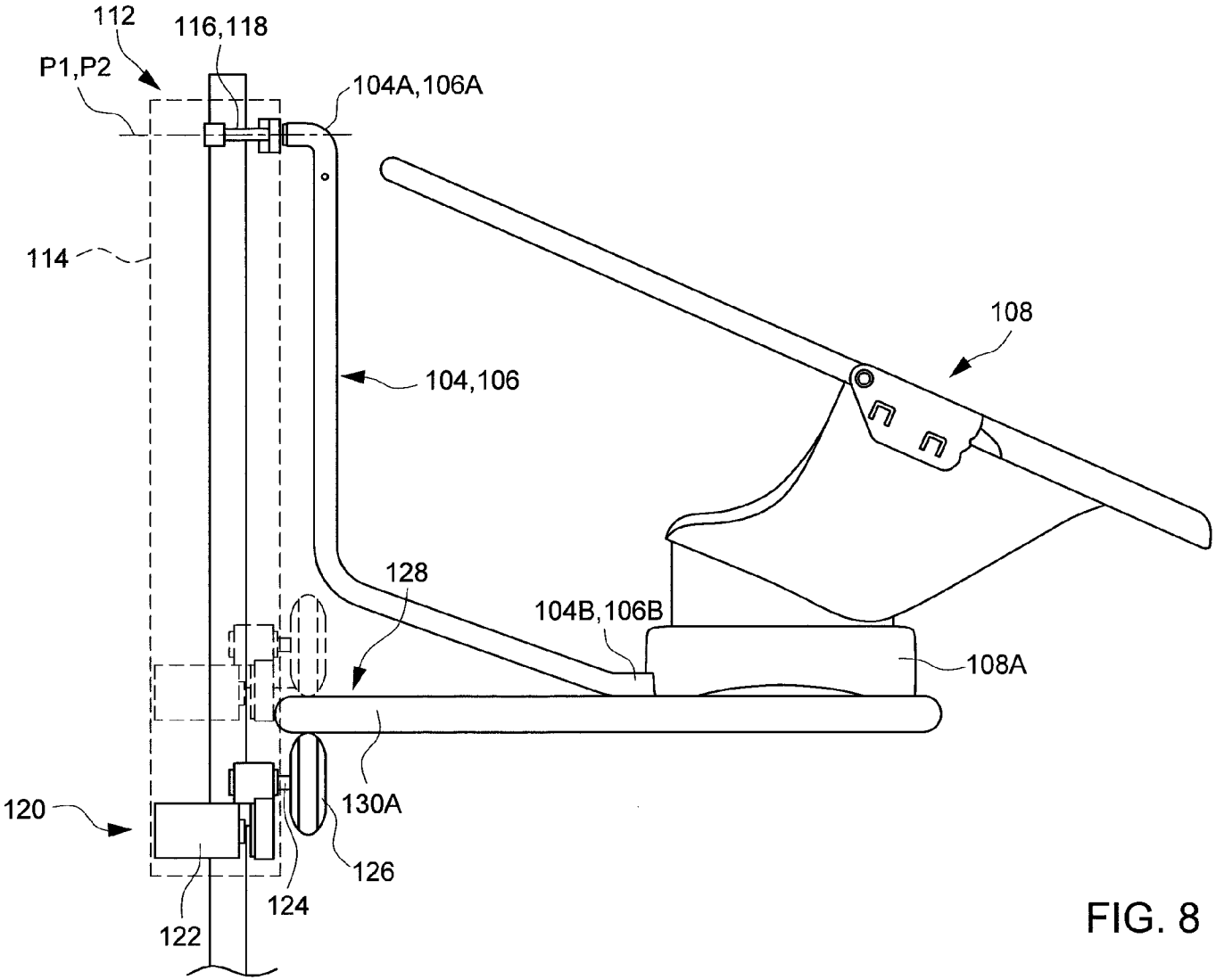

The aforementioned features and advantages may also be provided with other arrangements of the wheel 126 and the driven part 128, as exemplary shown in FIGS. 6-8. Rather than assembling the driven part 128 with the swing arms 104 and 106, FIG. 6 illustrates a variant embodiment in which the driven part 128 can be affixed with the seat support 108. As shown, the seat support 108 can include an extension 132 that projects toward the upright column 112 and is affixed with the board 130 of the driven part 128. The board 130 can be thereby affixed with the seat support 108, and movable along with the seat support 108. Like previously described, the wheel 126 can be in constant rolling contact with the board 130 to impart swing motion to the board 130, the swing arms 104 and 106, and the seat support 108.

FIG. 7 is a schematic view illustrating another variant embodiment in which the driven part 128 can include a grooved rack 140, and the wheel 126 rotating about a vertical axis can include a plurality of teeth 142 engaging with the rack 140. The rack 140 can be assembled with the seat support 108 (as shown), or the swing arms 104 and 106 in a manner similar to the board 130 shown in FIGS. 3 and 4. Owing to the gear engagement between the wheel 126 and the rack 140, rotation of the wheel 126 driven by the motor 122 can likewise impart swing motion to the rack 140, the swing arms 104 and 106, and the seat support 108.

FIG. 8 is a schematic view illustrating another embodiment in which the rotary axle 124 can extend horizontally, and the driven part 128 can include a board 130A that is installed in a horizontal position parallel to the rotary axle 124. The wheel 126 can be placed vertically below (as shown with the solid lines) or above (as shown with phantom lines) the board 130A, and in constant rolling contact with the board 130A to produce a reaction force that is substantially vertical. With this arrangement, rotation of the wheel 126 can also impart swing motion to the board 130A, the swing arms 104 and 106, and the seat support 108 relative to the support frame 102.

The drive mechanism 120 as described previously can drive motion of the swing arms 104 and 106 at an adjustable frequency in a vertical plane defined by the axes X and Z that is perpendicular to the pivot axes P1 and P2. As exemplary shown in FIGS. 9-16, the motion induced by the drive mechanism 120 can be combined with that produced by the vertical displacement of the housing 114 to allow a wide range of programmable motions in the vertical plane.

Figure 9:
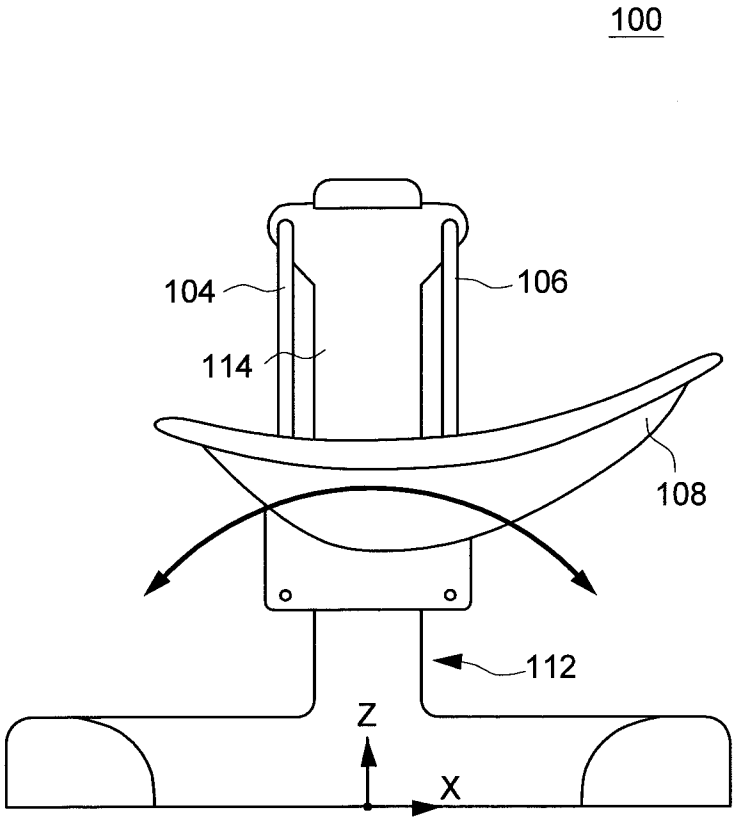
FIG. 9 is a schematic view illustrating a rainbow motion implemented in the child swing apparatus.

In FIG. 9, the arrow represents a "rainbow" motion in which the seat support 108 is at a relatively higher point when it is aligned with the upright column 112, and progressively descends from the higher point toward the left and right ends of the travel.

Figure 10:
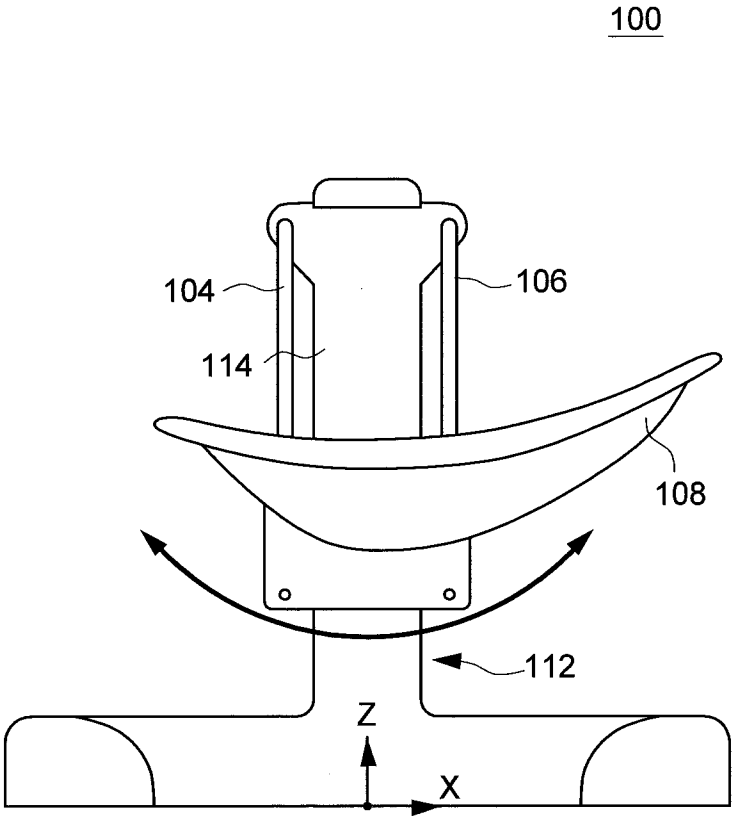
FIG. 10 is a schematic view illustrating a swing motion implemented in the child swing apparatus.

In FIG. 10, the arrow represents a "swing" motion in which the seat support 108 is at a relatively lower point when it is aligned with the upright column 112, and progressively ascends from the lower point toward the left and right ends of the travel.

Figure 11:
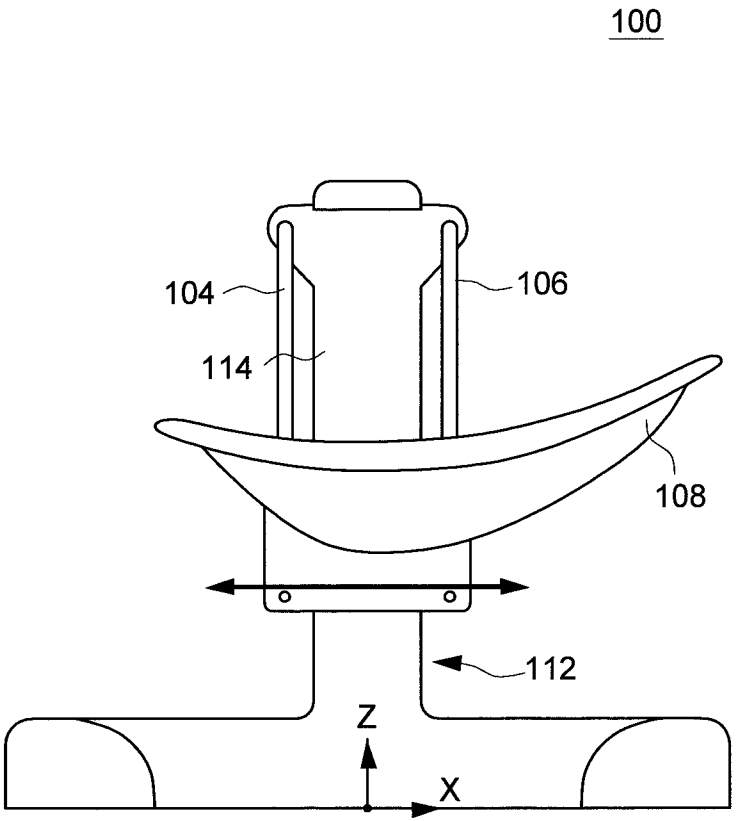
FIG. 11 is a schematic view illustrating a glide motion implemented in the child swing apparatus.

In FIG. 11, the arrow represents a "glide" motion in which the seat support 108 travels only horizontally to the left and right.

Figure 12:
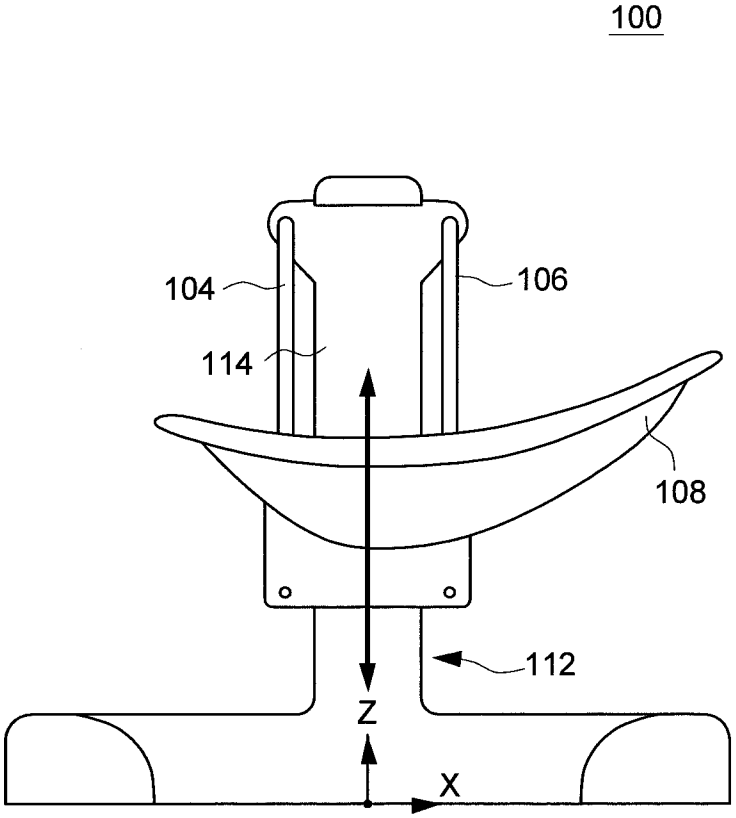
FIG. 12 is a schematic view illustrating a vertical motion implemented in the child swing apparatus.

In FIG. 12, only the housing 114 is driven in movement so as to impart a motion of the seat support 108 along the vertical axis Z.

Figure 13:
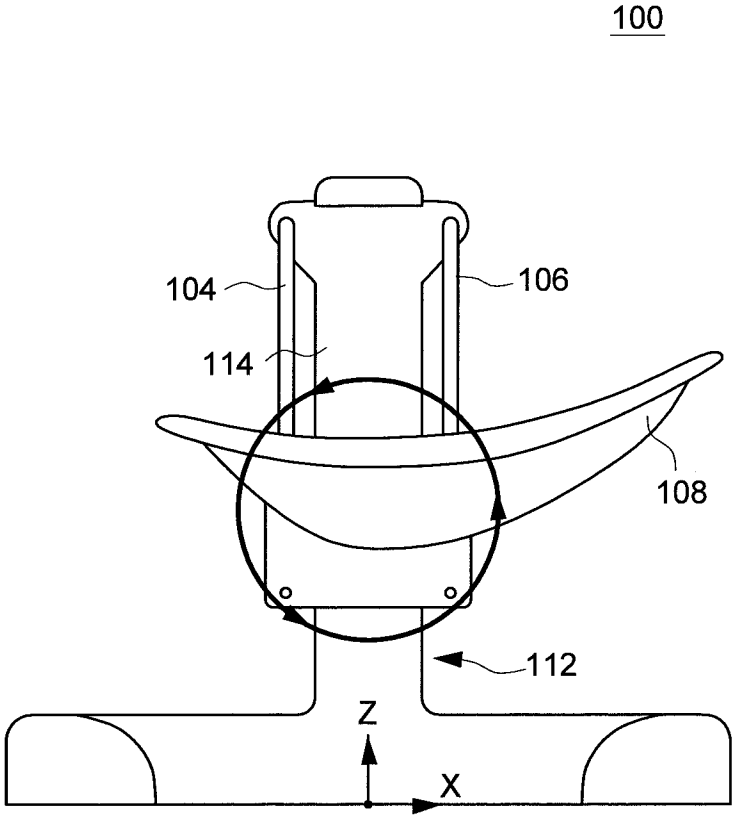
FIG. 13 is a schematic view illustrating an orbital motion implemented in the child swing apparatus.

In FIG. 13, the arrow represents an "orbital" motion in which the seat support 108 travels along a circular path in the vertical plane defined by the axes X and Z.

Figure 14:
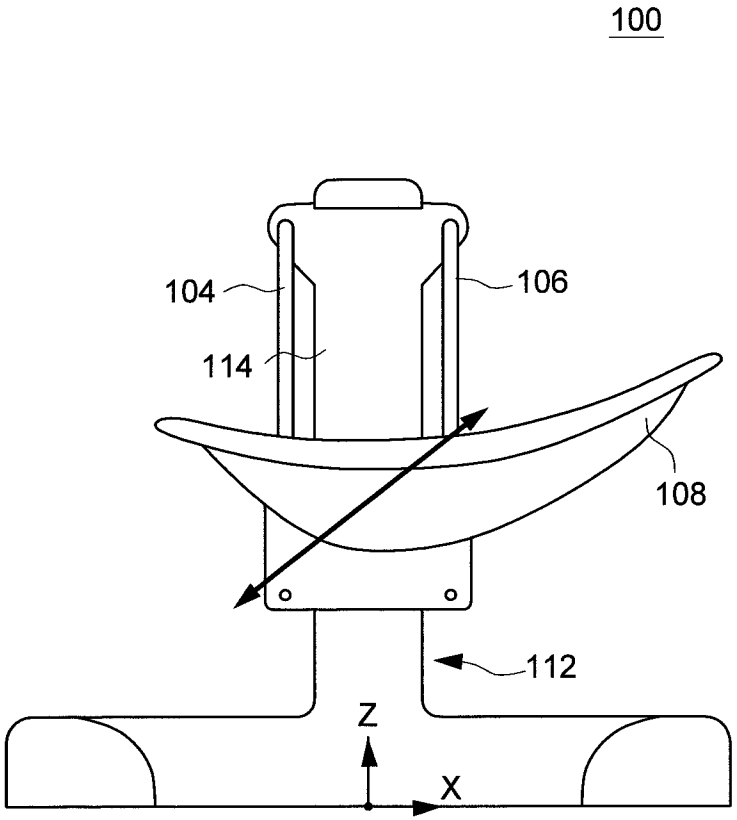
FIG. 14 is a schematic view illustrating a diagonal motion implemented in the child swing apparatus.

In FIG. 14, the arrow represents a "diagonal" motion in which the seat support 108 travels along a linear path from a lowest point at the left end to a highest point at the right end.

Figure 15:
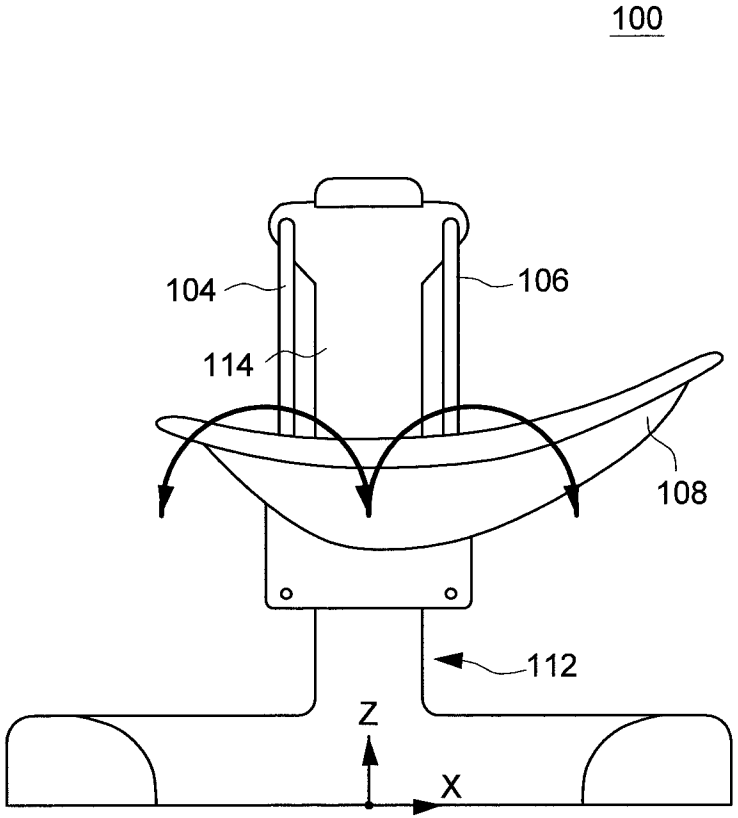
FIG. 15 is a schematic view illustrating a bounce motion implemented in the child swing apparatus.

In FIG. 15, the arrow represents a "bounce" motion in which the seat support 108 travels along a path that has three lower points at the left and right ends and a middle position between the left and right ends, and has an arc shape between each pair of adjacent lower points.

Figure 16:
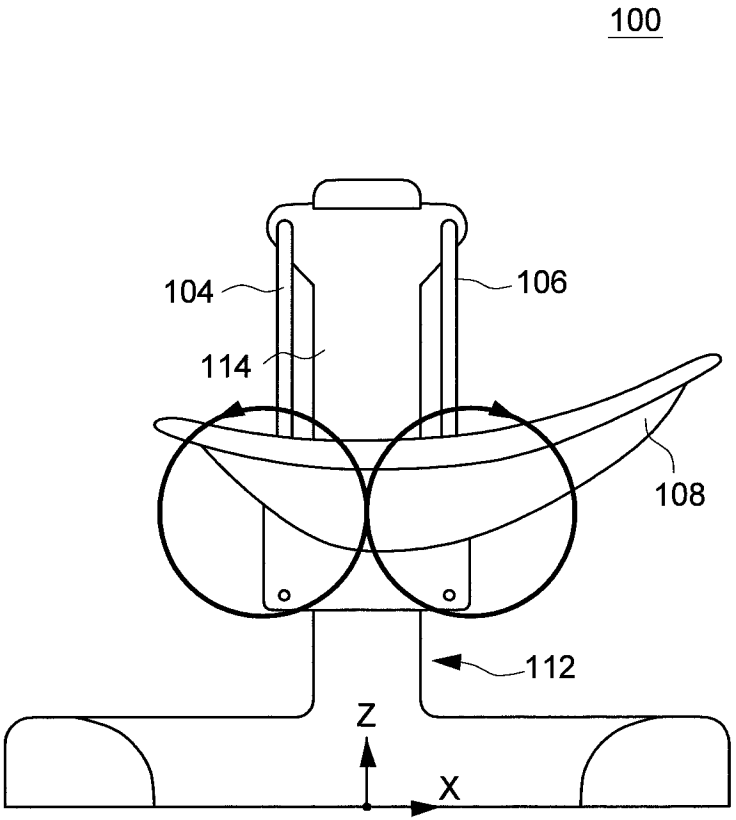
FIG. 16 is a schematic view illustrating a motion having an "8" shaped figure implemented in the child swing apparatus.

In FIG. 16, the arrow represents a motion in which the seat support 108 travels along a "8-shaped" path in the vertical plane defined by the axes X and Z.

Advantages of the swing apparatuses described herein include the ability to provide a broader range of swinging frequencies, speeds and motion paths. Moreover, the swing apparatuses can operate with a motor having a smaller torque output.

Realizations of the child swing apparatuses have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. A child swing apparatus comprising:

a support frame;

a seat support for receiving the placement of a child;

a swing arm assembled with the support frame about a pivot axis, the swing arm holding the seat support;

a driven part arranged radially spaced apart from the pivot axis and movable along with the seat support and the swing arm relative to the support frame; and a drive mechanism assembled with the support frame and having a driving end operable to apply a torque on the driven part so as to cause swing motion of the seat support, wherein the drive mechanism includes a rotary axle, and a wheel driven in rotation by the rotary axle and in constant contact with the driven part.

2. The child swing apparatus according to claim 1, wherein the drive mechanism further includes a motor operable to drive the rotary axle.

3. The child swing apparatus according to claim 1, wherein the driven part includes a board that is assembled with either of the swing arm and the seat support, and the wheel is in rolling contact with the board.

4. The child swing apparatus according to claim 3, wherein the swing arm includes:

a vertical segment with which the board is pivotally connected; and a horizontal segment connected with the seat support.

5. The child swing apparatus according to claim 3, wherein the board is affixed with the seat support.

6. The child swing apparatus according to claim 1, wherein the wheel has an outer peripheral region made of a material including urethane or rubber that promotes grip contact with the driven part.

7. The child swing apparatus according to claim 1, wherein the driven part includes a grooved rack, and the wheel includes a plurality of teeth engaging with the rack.

8. The child swing apparatus according to claim 1, wherein the rotary axle extends vertically, the driven part includes a board disposed parallel to the rotary axle, and the wheel is placed in rolling contact with the board that produces a substantially horizontal reaction force.

9. The child swing apparatus according to claim 1, wherein the rotary axle extends horizontally, the driven part includes a board parallel to the rotary axle, and the wheel is placed vertically below or above the board and is in rolling contact with the board so as to produce a substantially vertical reaction force.

10. The child swing apparatus according to claim 1, wherein the swing arm is pivotally connected with the seat support.

11. The child swing apparatus according to claim 1, wherein the support frame includes an upright column, and a housing assembled with the upright column, and the swing arm is pivotally connected with the housing.

12. The child swing apparatus according to claim 11, wherein the housing is vertically movable along the upright column, and the driving end of the drive mechanism is movable vertically along with the housing.

13. The child swing apparatus according to claim 1, wherein the swing arm is connected with a lower portion of the seat support, and the location on the driven part where the torque is applied is at a vertical height that is substantially adjacent to that of the lower portion of the seat support.

14. The child swing apparatus according to claim 1, wherein the location on the driven part where the torque is applied is vertically below the pivot axis.

15. The child swing apparatus according to claim 1, wherein the drive mechanism is assembled with the support frame vertically below the pivot axis.

16. A child swing apparatus comprising:

a support frame;

a seat support for receiving the placement of a child;

a swing arm assembled with the support frame about a pivot axis, the swing arm being connected with a lower portion of the seat support, the swing arm and the seat support forming a swinging block;

a driven part radially spaced apart from the pivot axis and assembled with the swinging block; and a drive mechanism including:

a rotary axle assembled with the support frame; and a wheel driven in rotation by the rotary axle and in rolling contact with the driven part wherein the wheel is operable to apply a torque on the driven part to drive swing motion of the seat support, wherein the location on the driven part where the torque is applied is at a vertical height that is close to that of the lower portion of the seat support.

17. The child swing apparatus according to claim 16, wherein the drive mechanism further includes a motor driving the rotary axle.

18. The child swing apparatus according to claim 16, wherein the driven part includes a board that is assembled with the swing arm, and the wheel is in rolling contact with the board.

19. The child swing apparatus according to claim 18, wherein the swing arm includes:

a vertical segment with which the board is pivotally connected; and a horizontal segment connected with the seat support.

20. The child swing apparatus according to claim 18, wherein the board is affixed with the seat support.

21. The child swing apparatus according to claim 16, wherein the wheel has an outer peripheral region made of a material including urethane or rubber that promotes grip contact with the driven part.

22. The child swing apparatus according to claim 16, wherein the driven part includes a grooved rack, and the wheel includes a plurality of teeth engaging with the rack.

23. The child swing apparatus according to claim 16, wherein the rotary axle extends vertically, the board is disposed parallel to the rotary axle, and the wheel is placed in rolling contact with the board that produces a substantially horizontal reaction force.

24. The child swing apparatus according to claim 16, wherein the rotary axle extends horizontally, the driven part includes a board parallel to the rotary axle, and the wheel is placed vertically below or above the board and is in rolling contact with the board which produces a substantially vertical reaction force.

25. The child swing apparatus according to claim 16, wherein the swing arm is pivotally connected with the seat support.

26. The child swing apparatus according to claim 16, wherein the support frame includes an upright column, and a housing assembled with the upright column, and the swing arm is pivotally connected with the housing.

27. The child swing apparatus according to claim 26, wherein the housing is vertically movable along the upright column so as to cause vertical motion of the seat support, and the drive mechanism is movable vertically along with the housing.

28. The child swing apparatus according to claim 16, wherein the wheel is located vertically below the pivot axis.

* * * * *